US005794728A

United States Patent [19]

Palmberg

[11] Patent Number: 5,794,728

[45] Date of Patent: Aug. 18, 1998

[54] PERCUSSION ROCK DRILL BIT

[75] Inventor: Göran Palmberg, Sao Paulo, Brazil

[73] Assignee: Sandvik AB, Sandviken, Sweden

[21] Appl. No.: 772,286

[22] Filed: Dec. 20, 1996

[51] Int. Cl.[6] ..... E21B 10/36

[52] U.S. Cl. ..... 175/400; 175/418

[58] Field of Search ..... 175/398, 400, 175/417, 418, 419

[56] References Cited

U.S. PATENT DOCUMENTS

| | | | |
|---|---|---|---|
| 3,357,507 | 12/1967 | Stewart | 175/418 X |
| 3,955,635 | 5/1976 | Skidmore | 175/400 |
| 4,299,298 | 11/1981 | McEnery et al. | 175/418 |
| 5,025,875 | 6/1991 | Witt | 175/418 X |

FOREIGN PATENT DOCUMENTS

| | | | |
|---|---|---|---|
| 2601302 | 7/1977 | Germany | 175/400 |
| 1227799 | 4/1986 | U.S.S.R. | 175/418 |
| 2242464 | 2/1991 | United Kingdom | 175/417 |

*Primary Examiner*—David J. Bagnell
*Attorney, Agent, or Firm*—Burns, Doane, Swecker & Mathis, L.L.P.

[57] ABSTRACT

A rock drill bit for percussive drilling includes a head and a shank. The shank has a central boring in which a thread is provided. The thread cooperates with a corresponding thread in a drill string driven by a top hammer. The boring is connected to at least one fluid passage which emerges in or in the vicinity of a front face of the head. The fluid passage connects to a first groove which connects to a second groove, wherein at least three second grooves are provided and form between them axially forward lands. Each land carries a gauge insert. The gauge inserts are asymmetrically positioned on the drill bit, and the second groove extends radially inwards to or beyond an imaginary circle touching the radially innermost points of the inserts.

11 Claims, 2 Drawing Sheets

FIG. 1
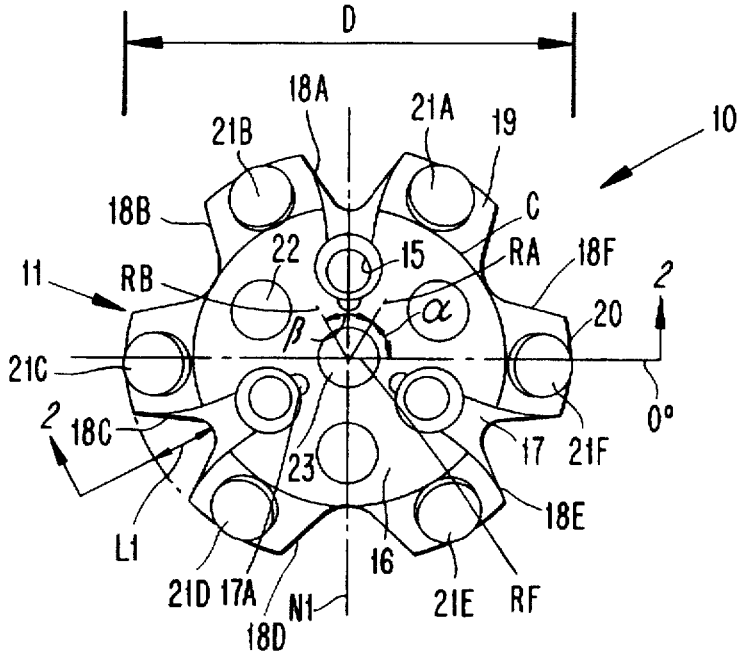
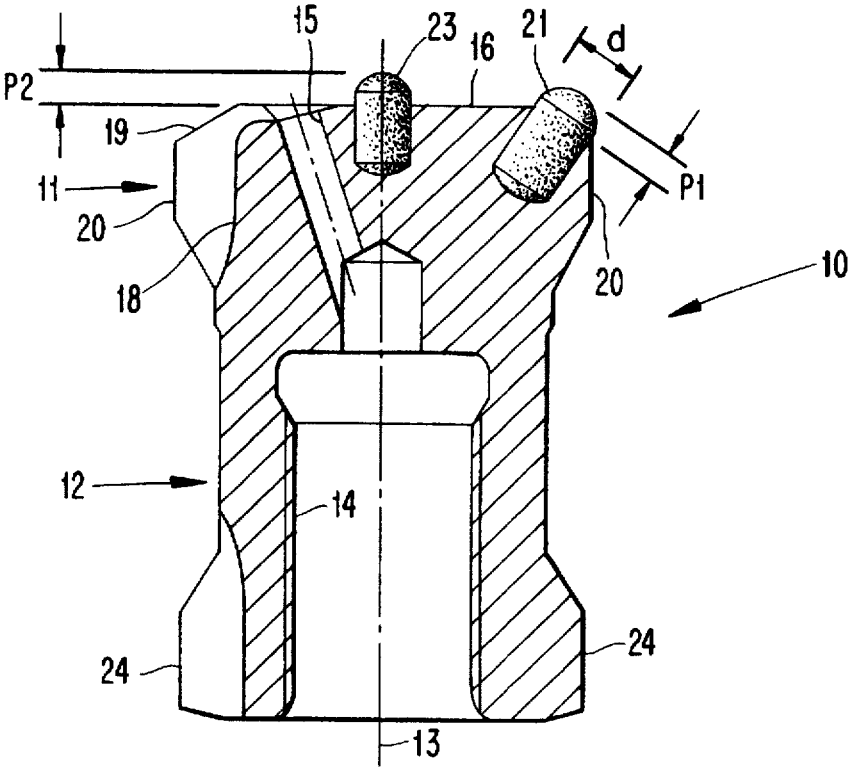
FIG. 2

FIG. 3
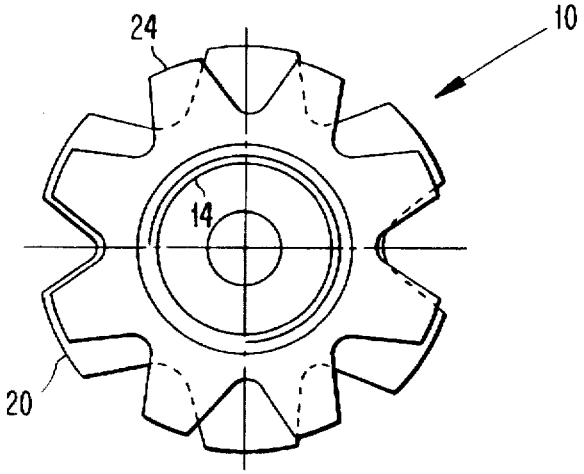
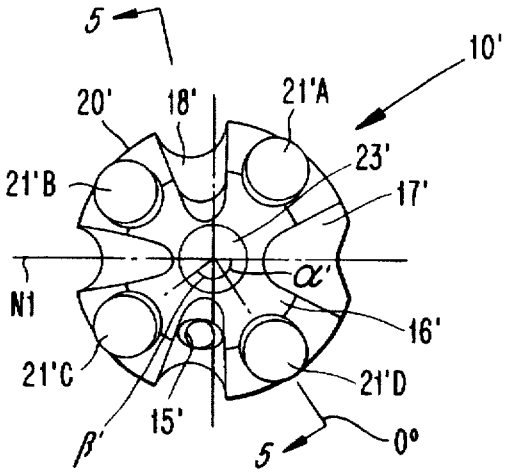
FIG. 4
FIG. 5
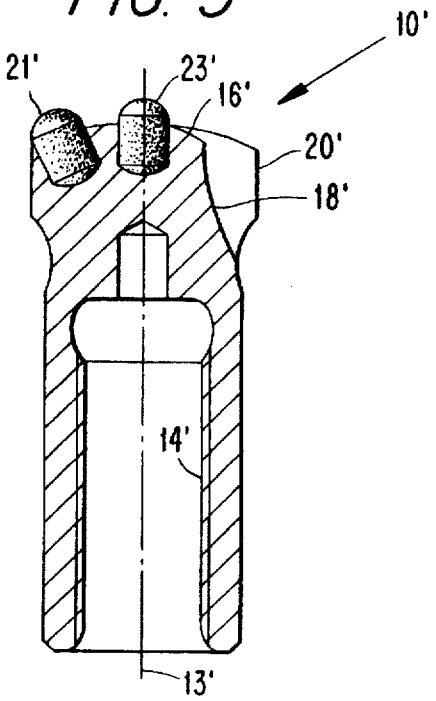

PERCUSSION ROCK DRILL BIT

BACKGROUND OF THE INVENTION

The present invention relates to a rock drill bit for percussive drilling, comprising a head and a shank and, in particular, to a relationship between gauge inserts and fluid-conducting grooves of the drill bit. The shank of a rock drill bit has a central boring in which a thread is provided, said thread being provided to cooperate with a corresponding thread in a drill string driven by a top hammer. The boring is connected to at least one fluid passage, which emerges in or in the vicinity of a front face of the head. The fluid passage connects to a plurality of generally radially extending first grooves formed in a front cutting face of the bit. Each of the first grooves connects to a generally axially extending second groove formed in an outer surface of the bit. At least three second grooves are provided and form between them circumferentially spaced lands, each of which carries a gauge insert.

Previously known drill bits of the above-mentioned type have a number of disadvantages. The chipways constitute only a small part of the total front face area of the head such that the average diameter of the cuttings has to be small. This means that the hitherto known bits are not particularly suited for excavation purposes. Furthermore, the gauge inserts are many in number relative to the diameter of the bit, which means that the chipways must be relatively small. Having many gauge inserts also involves costly and time-consuming regrinding efforts. In addition, the relatively poor flushing resulting from the narrow or small chipways makes it possible for cuttings to build up at the center of the front face. This built-up process impairs transfer of energy to the solid rock material in the bore which also impairs the threads in the drill string.

OBJECTS OF THE INVENTION

An object of the present invention is to provide a rock drill bit with asymmetrically positioned gauge inserts for enhancing the average diameter of the cuttings.

Another object of the present invention is to provide a rock drill bit with a limited number of big gauge inserts in comparison with the rock drill bit diameter, partly to increase diametrical wear and partly to facilitate the regrinding process.

Still another object of the present invention is to provide a rock drill bit which improves the transfer of energy to the solid rock material in the bore and which also spares the threads in the drill string.

SUMMARY OF THE INVENTION

These and other objects are achieved by the present invention which relates to a rock drill bit for percussive drilling. The drill bit comprises a head and a shank, the shank having a central boring in which a thread is provided. The thread is adapted to cooperate with a corresponding thread in a drill string driven by a top hammer. The boring is connected to at least one fluid passage which emerges at least in the vicinity of a front face of the head. The fluid passage connects to a radially extending first groove formed in the front face. A radially outer end of each first groove connects to a second groove which extends generally axially rearwardly. At least three of the second grooves are provided and form lands between one another. Each land carries a gauge insert. The gauge inserts are asymmetrically positioned relative to a center axis of the drill bit. Each second groove extends radially inwardly at least as far as an imaginary circle which touches radially innermost points of the gauge inserts as viewed in a direction parallel to the axis.

BRIEF DESCRIPTION OF THE DRAWINGS

FIG. 1 shows a front view of a rock drill bit according to a first embodiment of the present invention;

FIG. 2 shows the rock drill bit in a cross section along the line 2—2 in FIG. 1;

FIG. 3 shows the rock drill bit in a bottom or rear view;

FIG. 4 shows a front view of a rock drill bit according to a second embodiment of the invention; and FIG. 5 shows the rock drill bit in a cross section along the line 5—5 in FIG. 4.

DETAILED DESCRIPTION OF PREFERRED EMBODIMENTS OF THE INVENTION

A rock drill bit 10 for percussive drilling according to the present invention is shown in FIGS. 1 and 2. The rock drill bit 10 comprises a drill head 11 and a shank 12 and has a center axis 13. The shank has a central bore provided with a thread 14. The thread 14 is provided to cooperate with a corresponding thread in a drill string driven by a top hammer, not shown. The bore connects to three flushing channels 15 emerging in or in the vicinity of a front face 16 of the head 11. Preferably the front face 16 is perpendicular to the center axis 13.

Each channel 15 connects to a first groove 17 which has radially outwardly increasing width and depth and which connects to a second groove or chipway 18 (i.e., chipways 18A, 18C, 18E). Additional chipways 18 are provided which are not connected to a first groove 17, namely, chipways 18B, 18C, 18F. Each chipway 18 is substantially V-shaped as viewed in a direction parallel to axis 13, and extends axially rearwardly at substantially constant width and depth. The chipways 18 intersect a frustoconical bevel portion 19 of the front face 16.

Axially forward lands 20 protrude between the chipways 18. Each land 20 carries a gauge insert 21 (e.g., inserts 21A–21F) which is inclined about 35° relative to the center axis 13. The number of lands 20 is 4 to 10 (four to ten) and preferably 4 to 6 (four to six), depending on the size of the drill bit. The outer diameter of the drill bit is determined by the gauge inserts 21. The drill bit has three symmetry lines N1 perpendicular to the center axis 13.

The gauge inserts are asymmetrically positioned about the axis 13 of the drill bit but are symmetrically positioned on each land. With the line 2—2 as a reference line (see 0° in FIG. 1), the inserts 21A–21F are placed counter-clockwise as follows: insert 21A at 65°; 21B at 117.5°; 21C at 182.5°; 21D at 237.5°; 21E at 302.5° and 21F at 357.5°. This means that every other chipway 18B, 18D, and 18F has an available space proportional to 65° and that each of the rest of the chipways 18A, 18C and 18E has an available space proportional to 55°. An insert 21A is positioned such that its radius line RA forms a first angle $\alpha$ with a radius line RF of a first adjacent insert 21F. The radius line RA of insert 21A also forms a second angle $\beta$ with the radius line RB of a second adjacent insert 21B. The first angle $\alpha$ is always different from the second angle $\beta$. The advantage with such a geometry is the possibility to manufacture some large chipways on the drill bit. Thus, the chipways 18B, 18D, 18F are wider than the chipways 18A, 18C, 18E.

Each insert 21 projects a distance P1 perpendicularly from the bevel 19. Furthermore, three front inserts 22 and a center insert 23 are provided in the front face 16 and each projects a distance P2. The distance P1 is preferably somewhat larger than the distance P2, e.g., by about 1 mm. Each gauge insert 21 has a diameter d measured at the grip (shank) portion of the insert. The diameter d is as large as 10–30%, preferably 14–30%, of the diameter of the rock drill bit diameter D.

When comparing the available space or bow length for the chipway 18 with the diameter d of the gauge insert 21, such available space is 1.2 to 1.6 times the diameter d. The front inserts 22 and the flushing channels 15 form a crown of equal spacing about the center axis 13. Each chipway 18 has a radial extension L1 from the envelope surface of the lands 20 to the bottom of the V-shape that is 10–30% of the drill bit diameter D and preferably 14–30% of diameter D. Stated another way, the chipways 18 extend radially inwards to or beyond an imaginary circle C touching the radially innermost points of the inserts 21 in the plane of the front surface as viewed in a direction parallel to the axis 13. The number of gauge inserts 21 can be 4 to 10 (four to ten).

The first groove 17 includes a portion 17A that extends radially inwardly beyond the flushing channel 15 towards the center axis 13 of the drill bit and terminates in the vicinity of the central insert 23. The drill bit is provided with 6 (six) axially rearwards lands 24 which have equal spacing of 60°, see FIG. 3. The rearward lands 24 are provided to guide the drill bit in case of deflection. The envelope surface of the rearward lands 24 lies on a diameter which is less than the diameter of the envelope surface of the forward lands 20.

FIGS. 4 and 5 show an alternative embodiment of a drill bit 10' according to the present invention constructed for the drilling of smaller holes. Like reference numerals define like details as disclosed in connection with FIGS. 1–3. In this embodiment the drill bit is provided with one central insert 23' in the front face 16' and four gauge inserts 21'. No front inserts are present. Each chipway 18' is substantially V-shaped as viewed parallel to the axis 13 and its width increases axially rearwardly but its depth decreases axially rearwardly. The drill bit has only one symmetry line N1 oriented perpendicular to the center axis 13'. The drill bit has no rearward lands similar to lands 24 of FIG. 1. Also in this drill bit the gauge inserts 21' are asymmetrically positioned about the axis 13 but are centrally positioned on each land 20'. With the line 5—5 taken as a reference, see 0° in FIG. 5, the inserts 21' are spaced as follows in the counterclockwise direction: insert 21'A at 96°; 21'B at 96°; 185°; 21'C at 272°; and 21'D at 0°. This means that insert 21'D is positioned such that its radius line forms a first angle α' with the radius line of a first adjacent insert 21'A and a second angle β' with the radius line of a second adjacent insert 21'C. The first angle α' is always different (in this case larger) than the second angle β'. The groove 17' and its associated chipway (shown at the three o'clock position in FIG. 4) are wider than the other grooves and chipways.

Thus a drill bit with asymmetrically positioned gauge inserts 21 or 21' has been disclosed, having chipways occupying a relatively large part of the total area of the drill head in order to increase the average diameter of the cuttings and consequently to increase the penetration rate and facilitate geological sampling during ordinary drilling. The drill bit 10 or 10' has a relatively small number of large gauge inserts 21 or 21' compared to the diameter of the drill head to resist diametrical wear and to facilitate regrinding. The drill bit improves power transfer to the hole bottom, thereby increasing the penetration rate while sparing the threads in the drill string from blow reflexions.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed:

1. A rock drill bit for percussive drilling, comprising a head and a shank connected to the head, the shank having a central boring in which a thread is provided; the thread adapted to cooperate with a corresponding thread in a drill string driven by a top hammer; the boring connected to at least one fluid passage which emerges at least in the vicinity of a front face of the head; the fluid passage connecting to a radially extending first groove formed in the front face; a radially outer end of each first groove connecting to a second groove which extends generally axially rearwardly; wherein at least three of the second grooves are provided and form lands between one another, each land carrying a gauge insert; wherein the gauge inserts are asymmetrically positioned relative to a center axis of the drill bit; and wherein each second groove extends radially inwards at least as far as an imaginary circle which touches radially innermost points of the gauge inserts as viewed in a direction parallel to the axis, wherein a radius line of each gauge insert forms a first angle with a radius line of a first adjacent gauge insert and a second angle with a radius line of a second adjacent gauge insert, the first angle being different from the second angle; each gauge insert having a diameter which is 10–30% of an outer diameter of the rock drill bit, the second groove being substantially V-shaped as viewed in the direction parallel to the axis.

2. The rock drill bit according to claim 1 wherein the diameter of each gauge insert is 14–30% of the outer diameter of the rock drill bit.

3. The rock drill bit according to claim 1 wherein each second groove has a radial extension extending from an envelope surface of the lands to the bottom of the V-shape, that extension being 10–30% of the outer diameter of the drill bit, and wherein a bow length of the second groove is 1.2 to 1.6 times a diameter of the gauge insert.

4. The rock drill bit according to claim 3 wherein the radial extension is 14–30% of the outer diameter of the drill bit.

5. The rock drill bit according to claim 1 wherein the number of second grooves is larger than the number of first grooves, and wherein the second grooves form 4 to 10 lands, and wherein the number of gauge inserts is 4 to 10.

6. The rock drill bit according to claim 1, further including a center insert positioned on the axis, the first groove extending radially inwardly toward the center axis and terminating in the vicinity of the central insert, the gauge inserts being inclined at about 35° relative to the axis.

7. The rock drill bit according to claim 1 wherein the second grooves define chipways, there being additional chipways not connected to a first groove.

8. The rock drill bit according to claim 7 wherein at least one of the chipways is wider than at least one other of the chipways.

9. The rock drill bit according to claim 1 wherein at least one of the first grooves is wider than at least one other of the first grooves.

10. The rock drill bit according to claim 1, wherein the second groove extends rearwardly at substantially constant width and depth.

11. A rock drill bit for percussive drilling, comprising a head and a shank connected to the head, the shank having a central boring in which a thread is provided; the thread adapted to cooperate with a corresponding thread in a drill string driven by a top hammer; the boring connected to at least one fluid passage which emerges at least in the vicinity of a front face of the head; the fluid passage connecting to a radially extending first groove formed in the front face; a radially outer end of each first groove connecting to a second groove which extends generally axially rearwardly; wherein at least three of the second grooves are provided and form lands between one another, each land carrying a gauge insert; wherein the gauge inserts are asymmetrically positioned relative to a center axis of the drill bit; and wherein each second groove extends radially inwards at least as far as an imaginary circle which touches radially innermost points of the gauge inserts as viewed in a direction parallel to the axis, at least one of the grooves being wider than one other of the grooves.

* * * * *